US009815294B2

(12) United States Patent
Oi

(10) Patent No.: US 9,815,294 B2
(45) Date of Patent: *Nov. 14, 2017

(54) SYSTEM AND METHOD FOR EJECTING ADJUSTABLE AMOUNTS OF INK

(71) Applicant: FUNAI ELECTRIC CO., LTD., Osaka (JP)

(72) Inventor: Hideo Oi, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/380,534

(22) Filed: Dec. 15, 2016

(65) Prior Publication Data

US 2017/0096013 A1 Apr. 6, 2017

Related U.S. Application Data

(63) Continuation of application No. 14/921,679, filed on Oct. 23, 2015, now Pat. No. 9,555,640, which is a continuation of application No. 14/608,882, filed on Jan. 29, 2015, now Pat. No. 9,168,737.

(51) Int. Cl.

| | |
|---|---|
| ***B41J 2/175*** | (2006.01) |
| ***B41J 2/195*** | (2006.01) |
| ***B41J 2/045*** | (2006.01) |

(52) U.S. Cl.

CPC ..... *B41J 2/17566* (2013.01); *B41J 2/04586* (2013.01); *B41J 2/04588* (2013.01); *B41J 2/1753* (2013.01); *B41J 2/195* (2013.01); *B41J 2002/17589* (2013.01)

(58) Field of Classification Search

CPC ..... B41J 2/04586; B41J 2/04588; B41J 2/17566; B41J 2/1753; B41J 2/195

See application file for complete search history.

(56) References Cited

U.S. PATENT DOCUMENTS

| | | | | |
|---|---|---|---|---|
| 5,900,889 | A | 5/1999 | Tsukuda | |
| 7,296,882 | B2 | 11/2007 | Buehler et al. | |
| 7,950,766 | B2 | 5/2011 | Ejiri et al. | |
| 8,007,070 | B2 | 8/2011 | Kaga et al. | |
| 8,167,413 | B2 | 5/2012 | Ito | |
| 8,434,846 | B2 | 5/2013 | Tanaka | |
| 8,840,217 | B2 | 9/2014 | Yamagata | |
| 8,926,054 | B2 | 1/2015 | Emoto et al. | |
| 9,168,737 | B1 | 10/2015 | Oi | |
| 9,555,640 | B2 * | 1/2017 | Oi | B41J 2/17566 |

* cited by examiner

*Primary Examiner* — Lamson Nguyen

(74) *Attorney, Agent, or Firm* — Amster, Rothstein & Ebenstein, LLP

(57) ABSTRACT

A method for controlling an inkjet printing system including calculating a pigment concentration of ink ejected by the inkjet printhead relative to an initial pigment concentration of the ink based on a determined height of ink in an ink reservoir and a determined period of time since a last printhead activation. A firing pattern for the inkjet printhead is determined based on the determined height, the determined period of time and the calculated relative pigment concentration to account for settling of ink stored in the ink reservoir.

20 Claims, 9 Drawing Sheets

SYSTEM AND METHOD FOR EJECTING ADJUSTABLE AMOUNTS OF INK

FIELD

The present invention relates to systems and methods for maintaining a consistency of one or more qualities of ink ejected from a printhead associated with an inkjet printer, and in particular relates to systems and methods for adjusting an amount of ejected ink in response to a changed physical property of the ink over time.

BACKGROUND

Inkjet printers eject liquid ink droplets onto a recording medium, such as paper, from a printhead that moves relative to the recording medium and/or vice-versa. A printhead generally comprises one or more fluid ejection chips, each including a semiconductor substrate upon which one or more fluid actuator devices, such as electrical heater elements, are disposed for transferring thermal energy into liquid ink. The liquid ink is heated such that a rapid volumetric change occurs in the ink resulting from a liquid to vapor transition and, consequently, the ink is forcibly ejected from the printhead as an ink droplet onto a recording medium.

As inkjet printheads are often subject to repeated and/or long-term use, a printhead typically includes a replaceable and/or replenishable ink reservoir, such as a cartridge, tank, bladder, or other volume for storing liquid ink. Over time, pigment within the ink stored in the reservoir may settle, resulting in varying concentrations of ink in the droplets ejected by the printhead. This results in inconsistent performance of the inkjet printing system.

SUMMARY

An object of the present invention is to provide an inkjet printing system and method that exhibits consistent print performance at least in terms of ink droplet concentration.

Another object of the present invention is to provide an inkjet printing system and method in which operation of an inkjet printhead is controlled so as to address changes in concentration of ink stored in an ink reservoir that may occur over time.

An inkjet printing system according to an exemplary embodiment of the present invention comprises: an inkjet printhead comprising a plurality of inkjet nozzles; an ink reservoir connected to deliver ink to the inkjet printhead; a fire count detection system that detects a number of times the inkjet printhead has been activated to eject ink from one or more of the plurality of inkjet nozzles; an ink height calculation system that determines a height of ink remaining in the ink reservoir based on the fire count detected by the fire count detection system; a time period detection system that determines a period of time between a last inkjet printhead activation time and a current inkjet printhead activation time; an ink concentration calculation system that determines a pigment concentration of ink ejected by the inkjet printhead relative to an initial pigment concentration of the ink based on the determined height and the determined period of time; an activation controller configured to generate nozzle activation signals; and a control module operatively connected to receive information from the ink height calculation system, the time period detection system and the ink concentration calculation system and configured to determine based on the information a firing pattern for the inkjet printhead and to cause the activation controller to generate the nozzle activation signals based on the determined firing pattern.

In an exemplary embodiment, the activation controller and the control module are contained in a single printer controller.

In an exemplary embodiment, the ink reservoir comprises a lid, and the ink height calculation system determines the height of ink further based on an initial volume of ink in the ink reservoir, an ink volume per nozzle fire and a surface area of the lid.

In an exemplary embodiment, the ink concentration calculation system determines the relative pigment concentration using the Mason-Weaver Equation.

In an exemplary embodiment, upon a condition that the control module determines that the relative pigment concentration is 1.0, the control module determines a firing pattern that results in a dot coverage over a first percentage of a print medium area.

In an exemplary embodiment, the first percentage is 50%.

In an exemplary embodiment, upon a condition that the control module determines that the relative pigment concentration is greater than a predetermined amount over 1.0, the control module determines a firing pattern that results in a dot coverage of a second percentage of the print medium area, the second percentage being less than the first percentage.

In an exemplary embodiment, the second percentage is 45% or less.

In an exemplary embodiment, upon a condition that the control module determines that the relative pigment concentration is less than a predetermined amount below 1.0, the control module determines a firing pattern that results in a dot coverage of a third percentage of the print medium area, the third percentage being greater than the first percentage.

In an exemplary embodiment, the third percentage is 55% or greater.

According to an exemplary embodiment of the present invention, a method for controlling an inkjet printing system comprising an inkjet printhead having a plurality of inkjet nozzles and an ink reservoir connected to deliver ink to the inkjet printhead, comprises the steps of: detecting a number of times the inkjet printhead has been activated to eject ink from one or more of the plurality of inkjet nozzles; calculating a height of ink remaining in the ink reservoir based on the detected number of times the inkjet printhead has been activated; determining a period of time between a last inkjet printhead activation time and a current inkjet printhead activation time; calculating a pigment concentration of ink ejected by the inkjet printhead relative to an initial pigment concentration of the ink based on the determined height and the determined period of time; determining, based on the determined height, the determined period of time and the calculated relative pigment concentration, a firing pattern for the inkjet printhead; and generating nozzle activation signals based on the determined firing pattern.

Other features and advantages of embodiments of the invention will become readily apparent from the following detailed description, the accompanying drawings and the appended claims.

BRIEF DESCRIPTION OF THE DRAWINGS

The features and advantages of the present invention will be more fully understood with reference to the following, detailed description of illustrative embodiments of the present invention when taken in conjunction with the accompanying figures, wherein.

DETAILED DESCRIPTION

Figure 1:
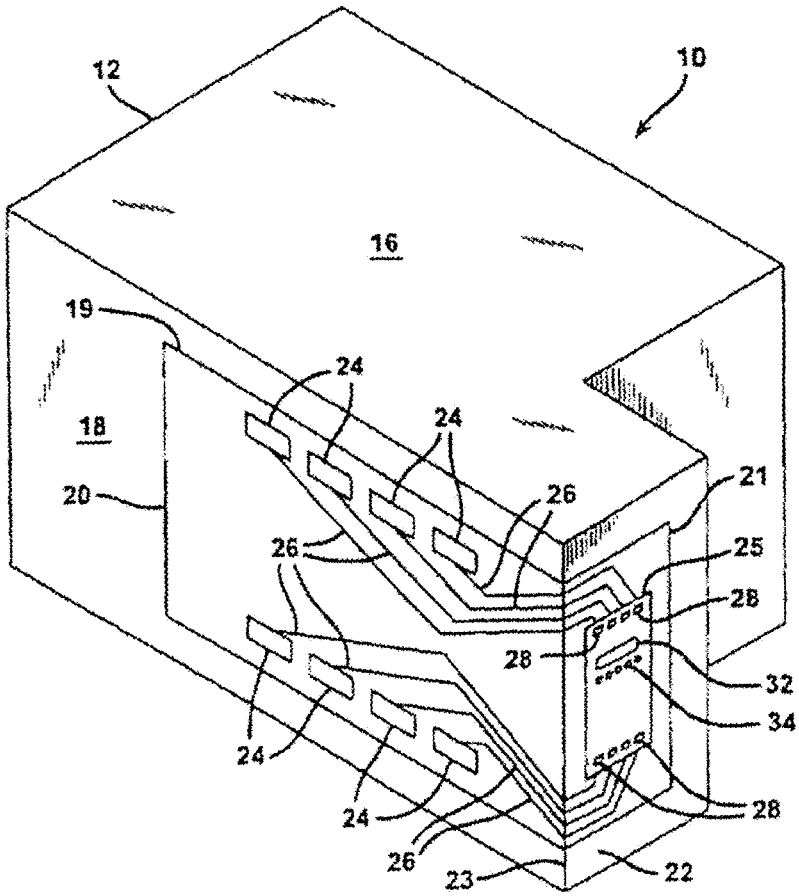
FIG. 1 is a perspective view of an inkjet printhead according to an exemplary embodiment of the present invention.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

FIG. 1 is an illustration of an inkjet printhead, generally designated by reference number 10, according to an exemplary embodiment of the present invention. The printhead 10 has a housing 12 formed of any suitable material for holding ink. Its shape can vary and often depends upon the external device that carries or contains the printhead. The housing has at least one internal compartment 16 for holding an initial or refillable supply of ink. In one embodiment, the compartment has a single chamber and holds a supply of black ink, photo ink, cyan ink, magenta ink or yellow ink. In other embodiments, the compartment 16 has multiple chambers and contains multiple supplies of ink. Preferably, the compartment 16 includes cyan, magenta and yellow ink. In still other embodiments, the compartment contains plurals of black, photo, cyan, magenta or yellow ink. It will be appreciated, however, that while the compartment 16 is shown as locally integrated within a housing 12 of the printhead, it may alternatively connect to a remote source of ink and receive supply, for example, from a tube.

Adhered to one surface 18 of the housing 12 is a portion 19 of a flexible circuit, especially a tape automated bond (TAB) circuit 20. The other portion 21 of the TAB circuit 20 is adhered to another surface 22 of the housing. In this embodiment, the two surfaces 18, 22 are perpendicularly arranged to one another about an edge 23 of the housing 12.

The TAB circuit 20 supports a plurality of input/output (I/O) connectors 24 for electrically connecting a heater chip 25 to an external device, such as a printer, fax machine, copier, photo-printer, plotter, all-in-one, etc., during use. Pluralities of electrical conductors 26 exist on the TAB circuit 20 to electrically connect and short the I/O connectors 24 to the input terminals (bond pads 28) of the heater chip 25. Those skilled in the art know various techniques for facilitating such connections. While FIG. 1 shows eight I/O connectors 24, eight electrical conductors 26 and eight bond pads 28, it will be understood that any number and/or configuration of connections may be provided.

The heater chip 25 contains a column 34 of a plurality of fluid firing elements that serve to eject ink from compartment 16 during use. The fluid firing elements may embody resistive heater elements formed as thin film layers on a silicon substrate. In embodiments, other types of configurations, such as those with piezoelectric elements, may be used. The pluralities of fluid firing elements in column 34 are shown adjacent an ink via 32 as a row of five dots but in practice may include several hundred or thousand fluid firing elements. As described below, vertically adjacent ones of the fluid firing elements may or may not have a lateral spacing gap or stagger therebetween. In general, the fluid firing elements have vertical pitch spacing comparable to the dots-per-inch resolution of an attendant printer. Some examples include spacing of $1/300^{th}$, $1/600^{th}$, $1/1200^{th}$, $1/2400^{th}$ or other of an inch along the longitudinal extent of the via. To form the vias, many processes are known that cut or etch the via 32 through a thickness of the heater chip. Some of the more preferred processes include grit blasting or etching, such as wet, dry, reactive-ion-etching, deep reactive-ion-etching, or other. A nozzle plate (not shown) has orifices thereof aligned with each of the heaters to project the ink during use. The nozzle plate may attach with an adhesive or epoxy or may be fabricated as a thin-film layer.

Figure 2:
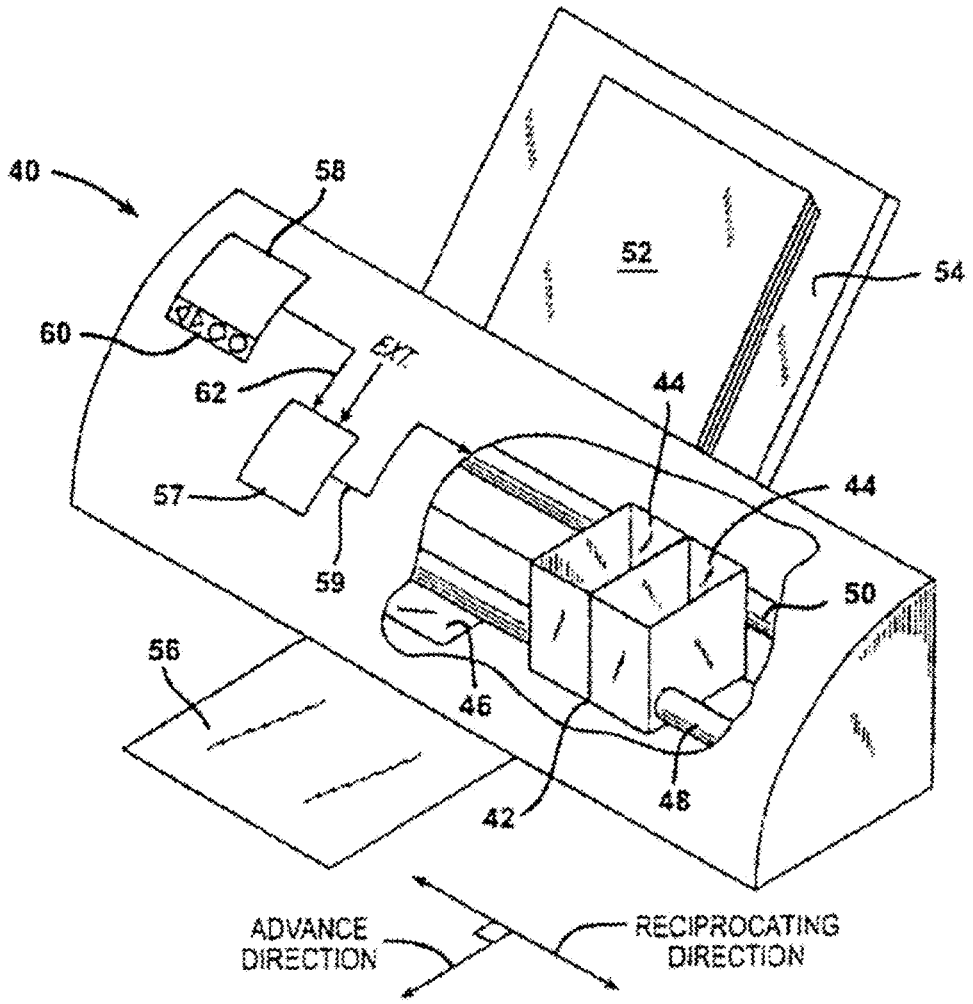
FIG. 2 is a perspective view of an inkjet printer according to an exemplary embodiment of the present invention.

FIG. 2 is an illustration of an external device in the form of an inkjet printer, generally designated by reference number 40, for containing the printhead 10, according to an exemplary embodiment of the present invention. The printer 40 includes a carriage 42 having a plurality of slots 44 for containing one or more printheads 10. The carriage 42 reciprocates (in accordance with an output 59 of a controller 57) along a shaft 48 above a print zone 46 by a motive force supplied to a drive belt 50. The reciprocation of the carriage 42 occurs relative to a print medium, such as a sheet of paper 52 that advances in the printer 40 along a paper path from an input tray 54, through the print zone 46, to an output tray 56.

While in the print zone, the carriage 42 reciprocates in the Reciprocating Direction generally perpendicularly to the paper 52 being advanced in the Advance Direction as shown by the arrows. Ink drops from compartment 16 (FIG. 1) are caused to be ejected from the heater chip 25 at such times pursuant to commands of a printer microprocessor or other controller 57. The timing of the ink drop emissions corresponds to a pattern of pixels of the image being printed. Often times, such patterns become generated in devices electrically connected to the controller 57 (via Ext. input) that reside externally to the printer for example, a computer, a scanner, a camera, a visual display unit, and/or a personal data assistant, to name a few.

To print or emit a single drop of ink, the fluid firing elements (the dots of column 34, FIG. 1) are uniquely addressed with a small amount of current to rapidly heat a small volume of ink. This causes the ink to vaporize in a local ink chamber between the heater and the nozzle plate and eject through, and become projected by, the nozzle plate towards the print medium. The fire pulse required to emit such ink drop may embody a single or a split firing pulse and is received at the heater chip on an input terminal (e.g., bond pad 28) from connections between the bond pad 28, the electrical conductors 26, the I/O connectors 24 and controller 57. Internal heater chip wiring conveys the fire pulse from the input terminal to one or many of the fluid firing elements.

A control panel 58, having user selection interface 60, also accompanies many printers as an input 62 to the controller 57 to provide additional printer capabilities and robustness.

It will be understood that the inkjet printhead 10 and inkjet printer 40 described above are exemplary, and that other inkjet printheads and/or inkjet printer configurations may be used with the various embodiments of the present invention.

Figure 3A:
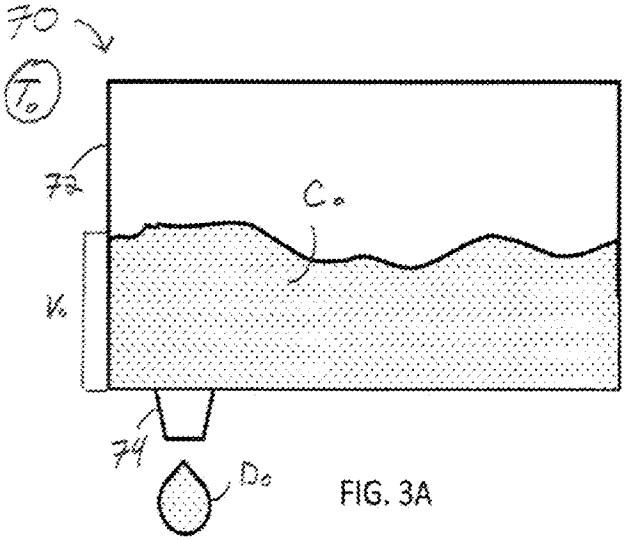
FIG. 3A is a first sequential schematic diagram of an inkjet printhead.

Turning now to FIG. 3A, a schematic diagram of a conventional printhead 70 is shown with a reservoir 72 filled with a volume $V_0$ of fluid, such as liquid ink. For clarity and ease of understanding, a nozzle 74 is shown as representative of the exit of the collective amount of ink ejected from printhead 70 during operation. In embodiments, the amount of ink illustrated as being ejected from nozzle 74 may be uniformly or non-uniformly distributed across any number of nozzles associated with a printhead.

Reservoir 72 of printhead 70 contains a volume of ink having a concentration of pigment such that:

$$C_n = M_n / V_n$$

where $C_n$=the concentration of pigment at a time interval n, $M_n$=the mass of pigment at time interval n, and $V_n$=the volume of ink at time interval n.

As shown, the concentration $C_0$ of the ink at time interval $T_0$ is substantially uniform so that multiple droplets of ink $D_0$ ejected from printhead 70 at time interval $T_0$ carry a substantially similar mass of pigment $M_0$ such that each droplet $D_0$ has a similar appearance when ejected onto a recording medium such as paper. Accordingly, time interval $T_0$ may be associated with an initial state of the printhead 70, for example, immediately following installation or filling of reservoir 72.

Figure 3B:
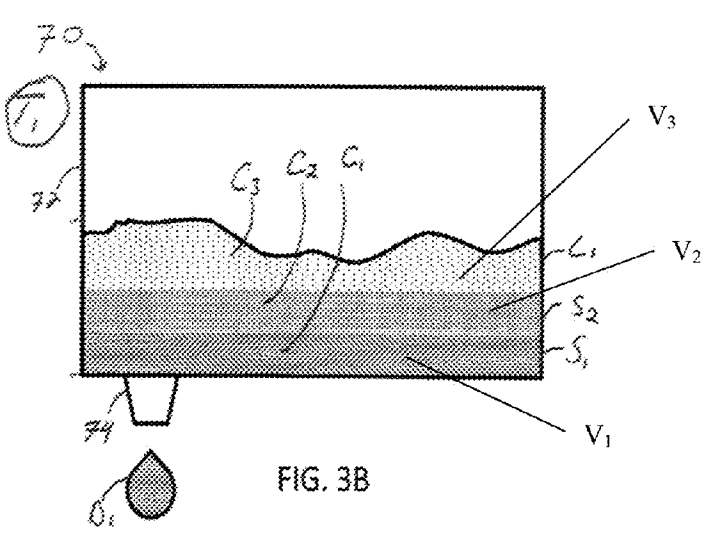
FIG. 3B is a second sequential schematic diagram of the inkjet printhead of FIG. 3A.

Turning to FIG. 3B, a time-shifted schematic diagram of printhead 70 is shown at a later time interval $T_1$, with the volume $V_1$ of ink disposed within reservoir 72 having been subjected to the effects of gravity so that one or more layers of sediment, such as layers $S_1$ and $S_2$ as shown, settle to the bottom of reservoir 72. The layers of sediment $S_1$, $S_2$ may include one or more relatively massive components of the ink, e.g., dyes and/or pigments, as compared to aqueous components L of the ink that may include, for example, water and/or other solutions. As shown, layer of sediment $S_1$ includes components of the ink that are more massive than the components of the ink that are disposed in layer of sediment $S_2$. In embodiments, it will be understood that any number of layers of sediment may settle from an ink, and may include solid and/or liquid components in any combination or separation.

Accordingly, at time interval $T_1$, reservoir 72 contains a volume of ink having a non-uniform density such that the aqueous portion L of the ink has a concentration of pigment $C_3$ (calculated as $M_3/V_3$), second layer of sediment $S_2$ (calculated as $M_2/V_2$) has a concentration of pigment $C_2$ that is greater than $C_3$, and the layer of sediment $S_1$ has a concentration of pigment $C_1$ (calculated as $M_1/V_1$) that is greater than $C_2$.

In this regard, due to the proximity of nozzle 74, e.g., nozzle apertures, to the layer of sediment $S_1$, a droplet of ink $D_1$ ejected at a first time interval $T_1$ may include a substantial amount of the components of the layer of sediment $S_1$ so that droplet of ink $D_1$ carries an amount of pigment such that the droplet of ink $D_1$ has a pigment concentration similar to $C_1$. Accordingly, the droplet of ink $D_1$ may have a relatively dark and/or saturated appearance as compared to droplet $D_0$ (FIG. 3A) when ejected onto a recording medium such as paper.

Figure 3C:
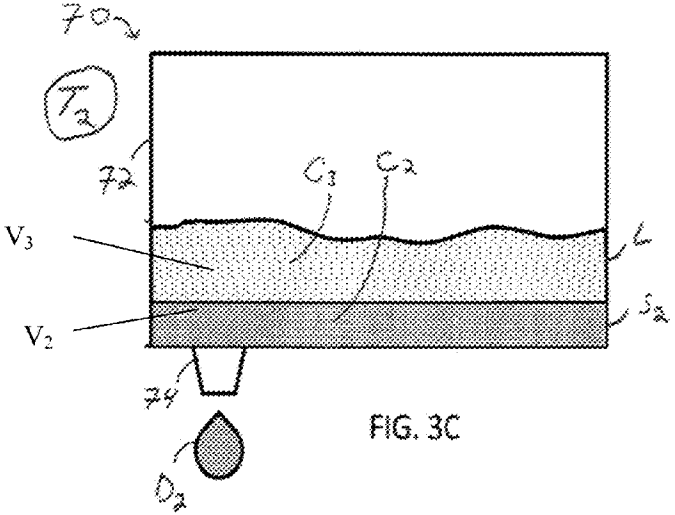
FIG. 3C is a third sequential schematic diagram of the inkjet printhead of FIG. 3A.

Turning to FIG. 3C, the reservoir 72 of printhead 70 is shown at a time interval $T_2$ that is greater than time interval $T_1$ such that most or all of the layer of sediment $S_1$ has been ejected from the printhead 70 via droplets of ink $D_1$ (FIG. 3B). Accordingly, further operation of the printhead 70 from time interval $T_2$ onward results in droplets of ink $D_2$ that are primarily composed of components from the layer of sediment $S_2$ due to the proximity of the layer of sediment $S_2$ to the nozzle 74. In this regard, a droplet of ink $D_2$ ejected at time interval $T_2$ carries an amount of pigment such that droplet $D_2$ has a pigment concentration similar to the concentration $C_2$ of layer of sediment $S_2$. As such droplets of ink $D_2$ may have a relatively dark appearance upon ejection onto a recording medium, though lighter than the appearance of droplets of ink $D_1$ (FIG. 3B).

Figure 3D:
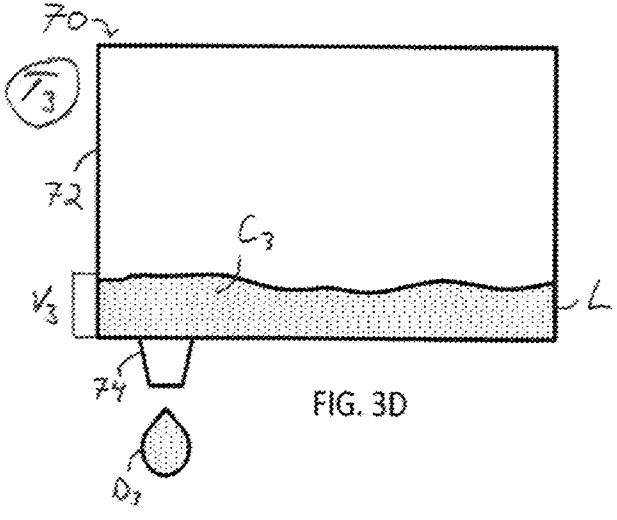
FIG. 3D is a fourth sequential schematic diagram of the inkjet printhead of FIG. 3A.

Turning to FIG. 3D, the reservoir 72 of printhead 70 is shown at a time interval $T_3$ that is greater than time interval $T_2$ such that most or all of the layer of sediment $S_2$ has been ejected from the printhead 70 via droplets of ink $D_2$. Accordingly, further operation of the printhead 70 from time interval $T_3$ onward results in droplets of ink $D_3$ that are substantially devoid of components from layers of sediment $S_1$, $S_2$. In this regard, droplets of ink $D_3$ are primarily composed of components from the aqueous component L of the ink. Accordingly, droplets of ink $D_3$ may have a substantially lighter appearance than droplets of ink $D_1$ and $D_2$ when ejected onto a recording medium such as paper.

From the foregoing, it will be understood that a concentration of pigment in ink droplets ejected from a printhead has a general dependency upon the length of time a volume of ink has been present within an ink reservoir. However, other factors such as frequency of use, rate of fluid ejection, and/or intervening maintenance operations of an inkjet printing system, to name a few, may effect the concentration of pigment in ink droplets of an inkjet printhead.

Accordingly, it is an object of the present invention to control the operation of an inkjet printhead in a manner such that the effects of pigment settling in ink stored in a reservoir can be mitigated and/or prevented. In this regard, the present invention is directed to an inkjet printhead and method of use that selectively controls which heaters to fire in order to account for pigment settling over time so as to maintain a consistent visual quality of the ejected ink over the course of the operating life of the printhead.

Figure 4:
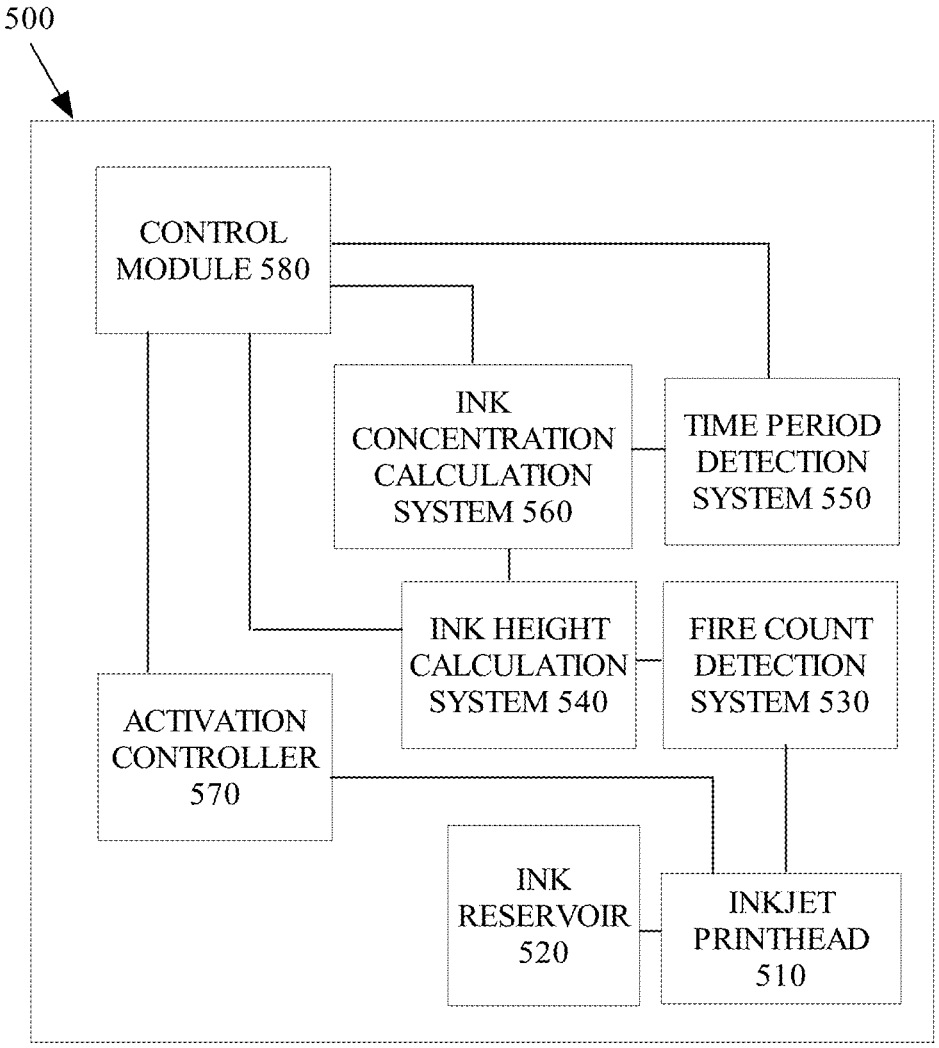
FIG. 4 is a block diagram illustrating an inkjet printing system according to an exemplary embodiment of the present invention.
Figure 5:
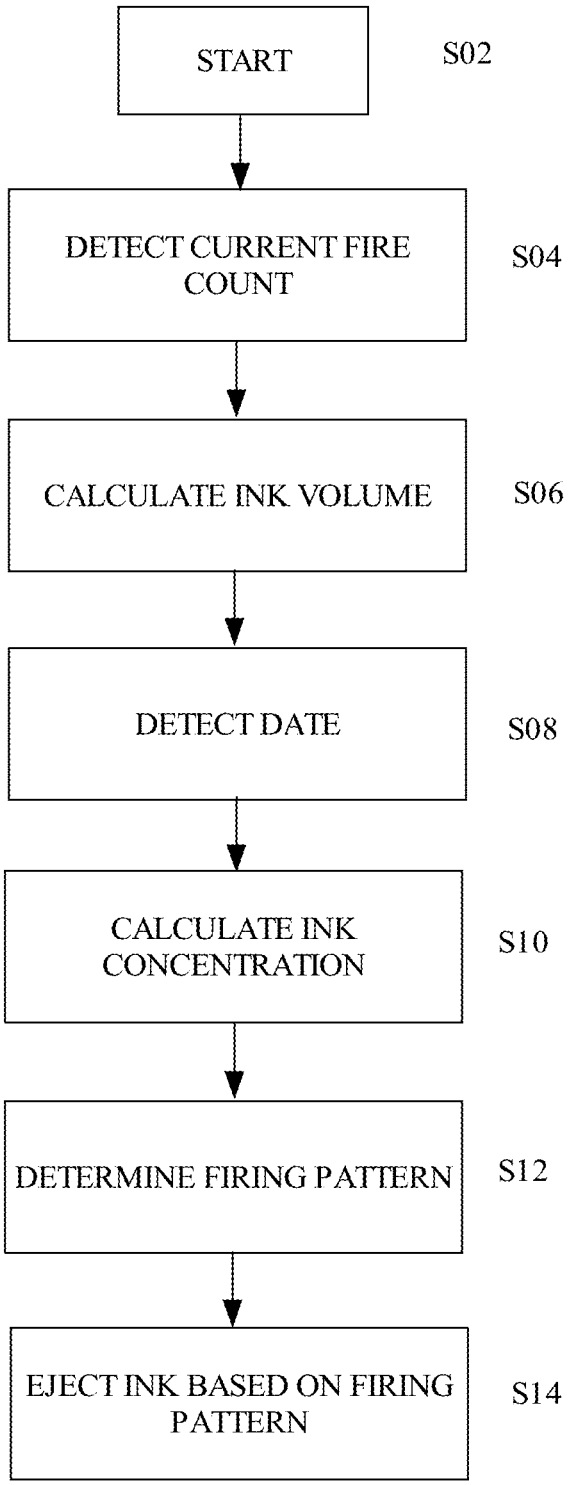
FIG. 5 is a flow chart illustrating a method of controlling operation of an inkjet printhead according to an exemplary embodiment of the present invention

FIG. 5 is a flowchart illustrating a method of controlling operation of an inkjet printhead according to an exemplary embodiment of the present invention. The various steps of the method are carried out automatically by the various components of an inkjet printing system. In this regard, FIG. 4 is a block diagram illustrating an inkjet printing system, generally designated by reference number 500, according to an exemplary embodiment of the present invention. The inkjet printing system 500 includes an inkjet printhead 510 having a plurality of inkjet nozzles, an ink reservoir 520 connected to deliver ink to the inkjet printhead, a fire count detection system 530 that detects a number of times the inkjet printhead has been activated to eject ink from one or more of the plurality of inkjet nozzles, an ink height calculation system 540 that determines a height of ink remaining in the ink reservoir based on the fire count detected by the fire count detection system, a time period detection system 550 that determines a period of time between a last inkjet printhead activation time and a current inkjet printhead activation time, an ink concentration calculation system 560 that determines a pigment concentration of ink ejected by the inkjet printhead relative to an initial pigment concentration of the ink based on the determined height and the determined period of time, an activation controller 570 configured to generate nozzle activation signals, and a control module 580 operatively connected to receive information from the ink height calculation system, the time period detection system and the ink concentration calculation system and configured to determine based on the information a firing pattern for the inkjet printhead and to cause the activation controller to generate the nozzle activation signals based on the determined firing pattern.

In step S02, the operation starts and proceeds to step S04, where the current fire count is detected. Such detection may be achieved by tracking and storing the fire count locally on the heater chip 25 of the printhead. For the purposes of the present invention, the term "fire count" refers to the number of times the printhead has been fired so as to eject drops of ink onto a print medium.

The operation then proceeds to step S06, where the volume of ink within the cartridge is calculated based on the fire count. Assuming the ink volume per fire is 12.5 $cm^3$/dot, the ink volume may be calculated using the following formula:

$$H=(V-(12.5*x))/S \tag{1}$$

where,
H=Ink Height [cm]
V=Initial Ink Volume [$cm^3$]
12.5=Ink Volume/Fire [$cm^3$/dot]
x=Fire count [dot]
S=cartridge lid area [$cm^2$]

The volume of ink may then be determined by multiplying the newly determined ink height with the cartridge lid area.

In step S08, the time since last jetting of the printhead is determined by comparing the current date with the last jetting date. The time is preferably measured in weeks, although other units of time may be tracked and measured.

The operation then continues to step S10, where the concentration of ink within droplets ejected from the printhead are determined based on the ink volume calculated in step S06 and the time determined in step S08. The concentration of ink may be calculated using the Mason-Weaver equation as follows:

$$\frac{n}{n_0} = \frac{e^{h/a}}{\alpha(e^{1/a}-1)} + (16\alpha^2\pi)\left(e^{(2b-t')/4a}\right) \tag{2}$$

-continued $$\sum_{m=1}^{\infty} \frac{\left(e^{-am^2\pi^2 r}\right)[m(1 \mp e^{-1/2\alpha})][(\sin m\pi h) + (2\pi m\alpha)\cos m\pi h]}{(1+4\pi^2 m^2\alpha^2)^2}$$

$$h = \frac{y}{L};\ (0 \le h \le 1);\ \alpha = \frac{A}{BL};\ \beta = \frac{L}{B};\ t' = \frac{t}{\beta};$$

$$\mp \Rightarrow (-\text{for } m = 2, 4, 6 \ldots),\ (+\ \text{for } m = 1, 3, 5 \ldots)$$

where, $$\frac{\partial n}{\partial t} = A\frac{\partial^2 n}{\partial y^2} - B\frac{\partial n}{\partial y}$$

n(y,t)=volumetric particle density
t=time
y=position; (y=0@top surface); (y=L@bottom surface)

$$A = \frac{KT}{6\pi\mu a};\ B = \frac{2ga^2(\rho_p - \rho_l)}{9\mu}$$

K=Boltzmann's constant
T=temperature
α=particle radius
μ=liquid viscosity
$(\rho_p-\rho_l)$=(particle density−liquid density)
Boundary conditions $$A\frac{\partial n}{\partial y} = Bn,\ \text{at } y = (0, L)$$

Initial condition:
$n(y,0)=n_0$=constant at t=0

Figure 6:
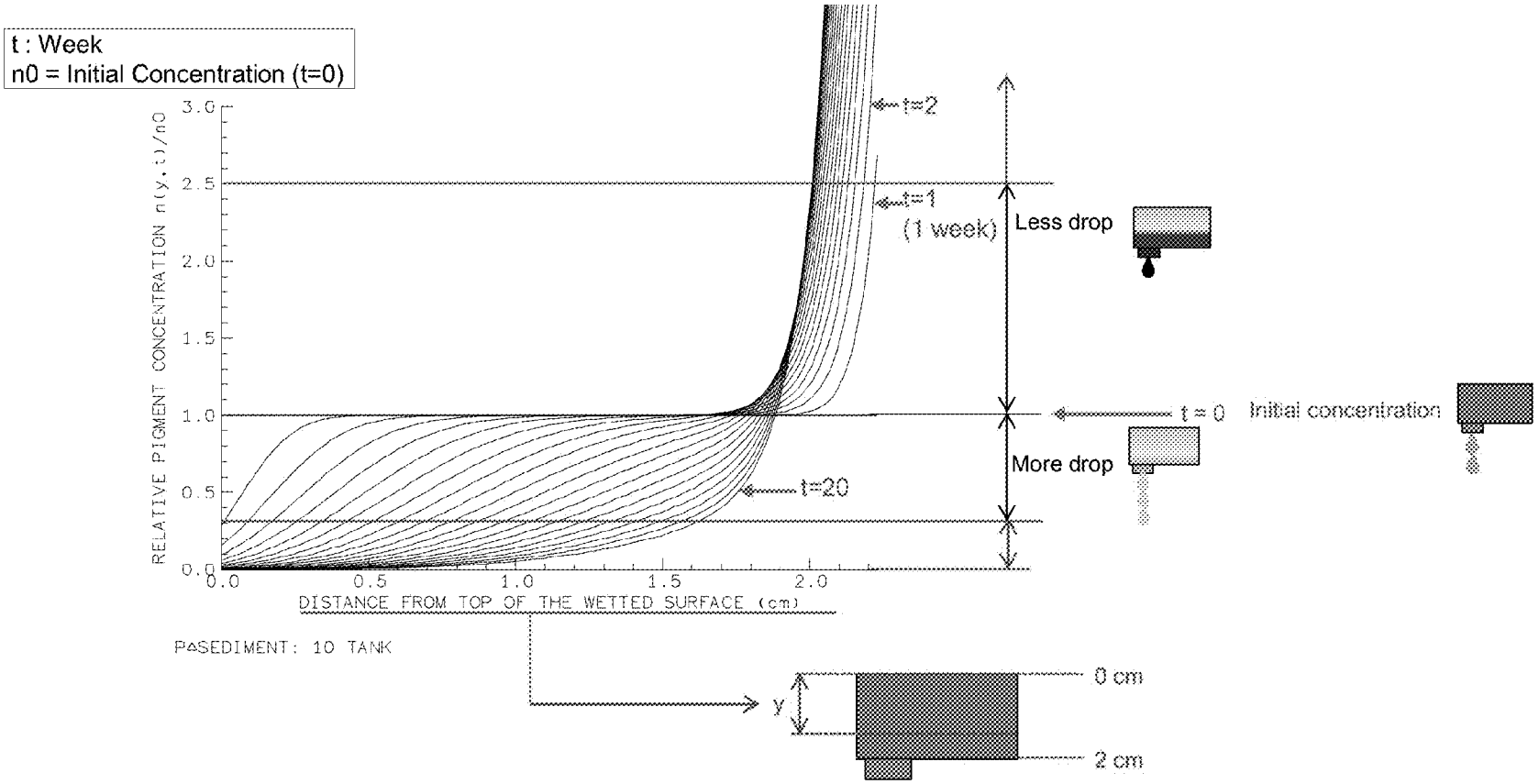
FIG. 6 is a graphical illustration of relative pigment concentration of ink stored in an inkjet printhead as a function of the level of the ink in the printhead and time.

The operation then proceeds to step S12, where it is determined which heaters to fire so as to maintain printing quality. In this step, ink concentration experience data is used to determine the firing pattern. In particular, FIG. 6 is a graphical representation of ink concentration experience data including the relative concentration of pigment in ejected droplets of ink (measured relative to an initial, substantially uniform concentration of the ink at an initial time $t_0$) as a function of the level of a volume of ink in the printhead (measured in cm) and time (measured in weeks). As shown, the relative pigment concentration of ejected droplets of ink may have a non-linear relationship with the amount of ink in the reservoir of the printhead, i.e., the relative concentration of pigment in ejected ink droplets may increase at a non-constant rate as ink is depleted from the reservoir of the printhead. Additionally, the empirical data represented in FIG. 6 illustrates that the relative pigment concentration of droplets of ink ejected from a printhead may be bound by a lower practical limit and/or an upper practical limit. In embodiments, a lower practical limit may correspond to a relative pigment concentration of ejected ink that is too low for the ejected ink to be visible on a recording medium, for example, a relative pigment concentration of ink at a level of about one third the initial concentration of the ink, as shown. In embodiments, an upper practical limit may correspond to a relative pigment concentration of ink that is too high for the ink to be properly ejected from the printhead, for example, a condition in which the ink is too viscous to properly flow through and/or from a printhead.

Fire pulses may be sent to the printhead based on the ink concentration experience data. For example, under the condition in which the relative pigment concentration is or close to 1.0 (i.e., the pigment concentration is or close to the initial pigment concentration), the printhead may be controlled to operate normally. If the relative pigment concentration falls to a particular level below 1.0, the printhead may be controlled to eject more drops than normal to account for the lighter drop quality, with more drops being ejected as the concentration falls. If the relative pigment concentration rises to a particular level above 1.0, the printhead may be controlled to eject less drops than normal to account for the darker drop quality, with less drops being ejected as the concentration rises.

Figure 7:
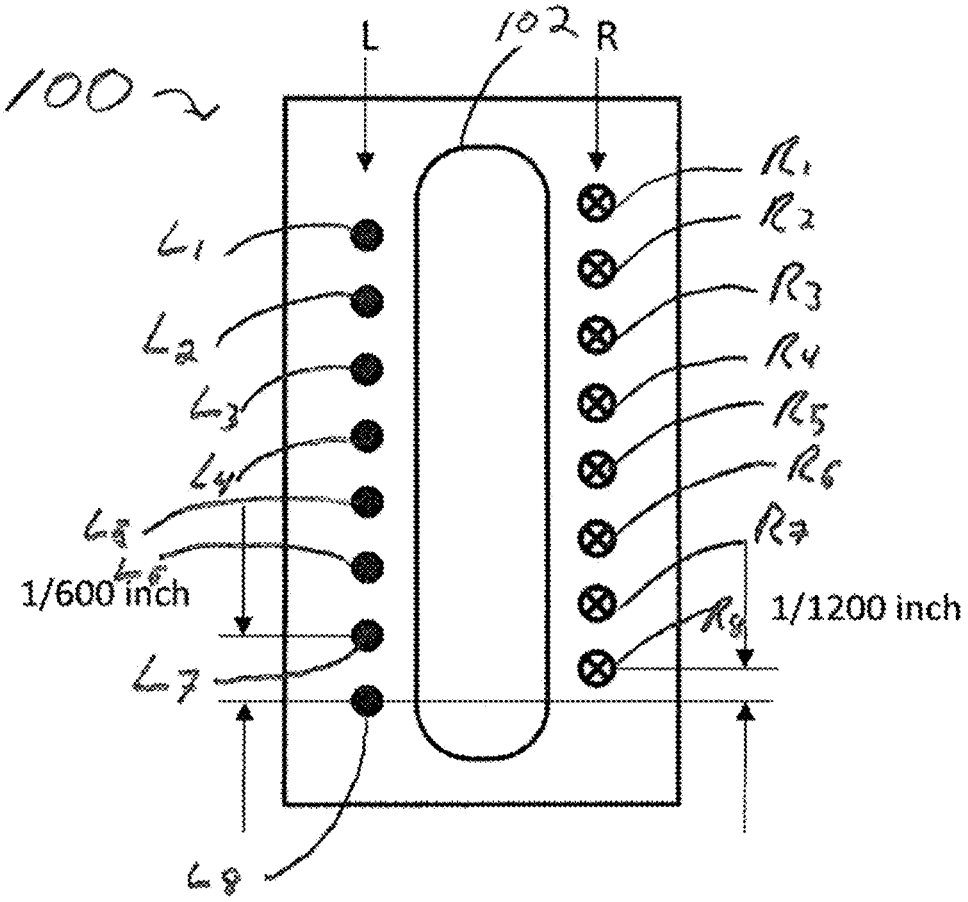
FIG. 7 is a schematic diagram of a fluid ejection chip for use with an inkjet printhead according to an exemplary embodiment of the present invention.

Turning to FIG. 7, a schematic diagram of a fluid ejection chip 100 for use with a printhead, for example, printhead 10 (FIG. 1), printhead 70 (FIG. 3A) or printhead 510 (FIG. 4) is illustrated. Fluid ejection chip 100 includes a centrally-disposed ink via 102 for locally storing ink. Accordingly, ink via 102 may be in fluid communication with a source of ink, such as a reservoir within a printhead or a remote source of ink such as an ink tank.

As shown, nozzles are arranged in columns L, R on opposing sides of ink via 102. Nozzles may be formed through a nozzle plate at positions corresponding to a fluid ejection actuator positioned beneath the plate (not shown). The fluid ejection actuators may be in fluid communication with ink from via 102 so that ink droplets can be ejected through nozzles onto a recording medium such as paper. As shown, fluid ejection chip 100 includes eight nozzles in each of columns L, R (labeled $L_1$-$L_8$, and $R_1$-$R_8$, respectively). It will be understood that in embodiments, a fluid ejection chip may include a greater number of nozzles, for example, hundreds or thousands of nozzles, which may have any desirable arrangement. Each of the vertically-adjacent nozzles shown may be separated a uniform distance from one another, for example, $1/600^{th}$ of an inch, with the columns L and R of nozzles being vertically offset from one another a distance of about half the uniform distance, for example, $1/1200^{th}$ of an inch. It will be understood that the relative spacing of the nozzles at least partially controls a pattern along which ink droplets ejected from fluid ejection chip 100 may fall onto a recording medium such that a print resolution, i.e., an amount of ejected ink present per unit area on the recording medium, is defined.

Figure 8A:
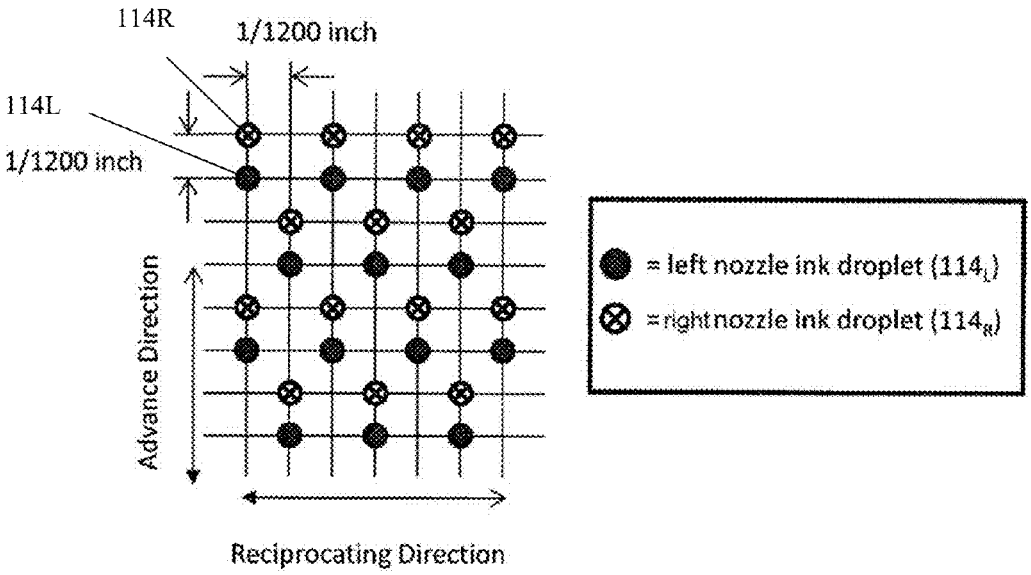
FIG. 8A is a schematic diagram of a pattern of ink droplets ejected from the fluid ejection chip of FIG. 7 according to an exemplary embodiment of the present invention.

Referring additionally to FIG. 8A, a schematic diagram of the placement of ink droplets ejected from fluid ejection chip 100 are shown against a $1/1200^{th}$ inch grid. FIG. 8A represents a portion of a single pass of a printhead carrying fluid ejection chip 100 across the Reciprocating Direction. The movement in the Reciprocating Direction is coordinated with movement of a recording medium such as a sheet of paper along the Advance Direction so that line-by-line printing onto the recording medium is possible. In embodiments, it will be understood that a printhead may make more than one pass along a single line, i.e., a printhead may make more than one pass across the Reciprocating Direction before the recording medium moves along the Advance Direction.

As shown, all or fewer of nozzles $L_1$-$L_8$ and $R_1$-$R_8$ may eject droplets of ink $\mathbf{114}_L$, $\mathbf{114}_R$ onto a recording medium during a pass of a printhead. In embodiments, such selective ejection of ink droplets from a printhead can be accomplished by the transmission of one or more electrical signals, e.g., fire pulses, to the fluid ejection actuators of a fluid ejection chip. The controller of the inkjet printing system, under automatic and/or manual control, for example, a default or manually selected print setting, may send a combination of fire pulses to a selected group of fluid ejection actuators in a process called addressing. In embodiments, multiple series of fire pulses may be transmitted to a selected group of fluid ejection actuators during a single pass of a printhead. Such fire pulses may cause a fluid ejection actuator to fire more than once during a single pass of the printhead. In embodiments, a controller of an inkjet printing system may cause a series of fire pulses to change during or between passes of a printhead, as described further herein.

Still referring to FIGS. 7 and 8A, droplets of ink $\mathbf{114}_L$ are ejected through nozzles $L_1$ and $L_3$ in a first series of fire pulses, followed by the ejection of droplets of ink $\mathbf{114}_L$ through nozzles $L_2$ and $L_4$ in a second, subsequent series of fire pulses. As shown, the controller of the inkjet printing sends the first series of fire pulses and the second series of fire pulses in an alternating fashion with each advance of the printhead by $1/1200^{th}$ of an inch in the Reciprocating Direction.

Similarly, droplets of ink $\mathbf{114}_R$ are ejected through nozzles $R_1$ and $R_3$ in a first series of fire pulses, followed by the ejection of droplets of ink $\mathbf{114}_R$ through nozzles $R_2$ and $R_4$ in a second, subsequent series of fire pulses. Again, the controller of the inkjet printing sends the first series of fire pulses and the second series of fire pulses in an alternating fashion with each advance of the printhead by $1/1200^{th}$ of an inch in the Reciprocating Direction.

Such an ejection pattern of ink droplets may be consistent with a condition in which a printhead includes a reservoir of ink having a substantially uniform pigment concentration so that the ejects droplets of ink have a pigment concentration that is substantially equivalent to the pigment concentration of the ink at time $T_0$. In such an instance, it may be desirable to control a printhead to fire fewer than all of its fluid ejection actuators, but greater than a minimum number of its fluid ejection actuators. Such a configuration affords flexibility in changing the ink droplet ejection pattern in response to changing conditions within or without the printhead, as described further herein.

Figure 8B:
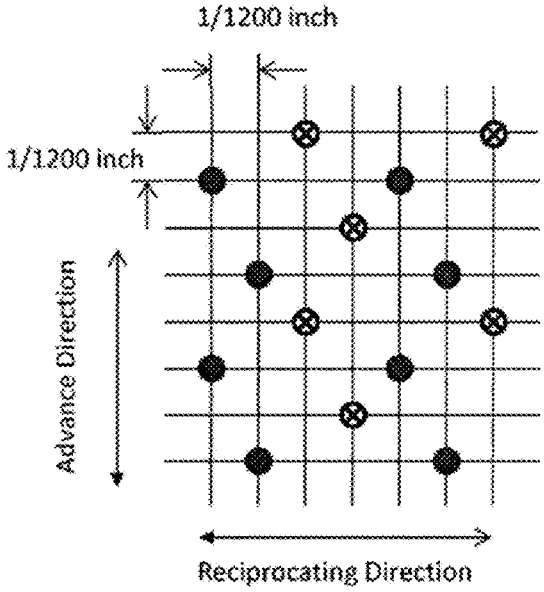
FIG. 8B is a schematic diagram of a pattern of ink droplets ejected from the fluid ejection chip of FIG. 7 according to an alternative embodiment of the present invention.

Turning to FIG. 8B, and still referring to FIG. 7, a schematic diagram of an ink droplet ejection pattern is shown according to an alternative series of fire pulses provided to fluid ejection chip 100 in a condition in which ink stored in a reservoir of a printhead has become subject to the effects of settling, e.g., so that more massive components of the ink separate and fall under the effects of gravity to form concentrated regions of pigment near the nozzles of the printhead. Such a condition may be similar to printhead 70 at time intervals $T_1$ or $T_2$ (FIGS. 3B and 3C above). It would be desirable to adjust the amount of ink ejected from the printhead in response to the changed pigment concentration of the ejection ink.

Accordingly, a controller of an inkjet printing system may send a series of fire pulses to the printhead to cause a fewer number of fluid ejection actuators to fire. As shown, during a portion of the pass of the printhead, droplets of ink $\mathbf{114}_L$ are ejected through nozzles $L_1$ and $L_3$ in a first series of fire pulses, followed by the ejection of droplets of ink $\mathbf{114}_L$ through nozzles $L_2$ and $L_4$ in a second, subsequent series of fire pulses. Similarly, droplets of ink $\mathbf{114}_R$ are ejected through nozzles $R_1$ and $R_3$ in a first series of fire pulses, followed by the ejection of droplets of ink $\mathbf{114}_R$ through nozzles $R_2$ and $R_4$ in a second, subsequent series of fire pulses.

However, while the second series of fire pulses follows the first series of fire pulses for each of the columns L, R of nozzles (FIG. 7) after the printhead has advanced $1/1200^{th}$ of an inch in the Reciprocating Direction as above, the respective first series of fire pulses do not repeat again until after the printhead has advanced $1/3400^{th}$ of an inch in the Reciprocating Direction. Accordingly, approximately half the number of ink droplets are ejected from the printhead in this configuration as compared to the number of ink droplets ejected from the printhead in the embodiment shown in FIG. 8 above. Such a configuration may be desirable for ink having a relatively high pigment concentration, for example, to avoid using unnecessary amounts of pigment, to maintain a consistent visual quality of ejected ink, and or to extend the operating life of a given reservoir of ink.

Figure 8C:
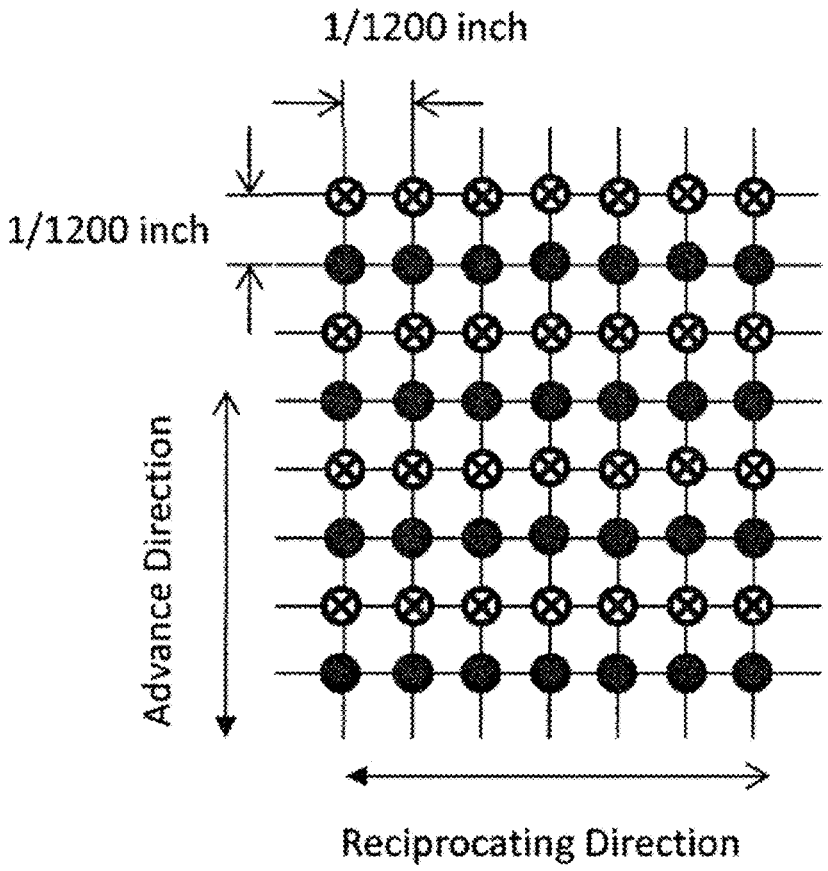
FIG. 8C is a schematic diagram of a pattern of ink droplets ejected from the fluid ejection chip of FIG. 7 according to another alternative embodiment of the present invention.

Turning to FIG. 8C, and still referring to FIG. 7, a schematic diagram of an ink droplet ejection pattern is shown according to an alternative series of fire pulses provided to fluid ejection chip 100 in a condition in which ink within the reservoir of a printhead has a lowered concentration of pigment as compared to its initial condition. Such a condition may be similar to printhead 70 at time interval $T_3$ above (FIG. 3D). As shown, during a portion of the pass of the printhead, droplets of ink $\mathbf{114}_L$ are ejected through nozzles $L_1$, $L_2$, $L_3$ and $L_4$ in a single series of fire pulses that repeats when the printhead has advanced $1/1200^{th}$ of an inch in the Reciprocating Direction. Similarly, droplets of ink $\mathbf{114}_R$ are ejected through nozzles $R_1$, $R_2$, $R_3$ and $R_4$ in a single series of fire pulses that repeats when the printhead has advanced $1/1200^{th}$ of an inch in the Reciprocating Direction.

Accordingly, approximately twice the number of ink droplets are ejected from the printhead in this configuration as compared to the number of ink droplets ejected from the printhead in the embodiment shown in FIG. 8A above. Such a configuration may be desirable for ink having a relatively lower pigment concentration, for example, to ensure that a sufficient amount of pigment is ejected onto the recording medium and/or to maintain a consistent visual quality of ejected ink.

It will be understood that any number and/or combination of fire pulses may be provided to effect an ink ejection pattern suitable to counteract the effects of pigment settling in the ink stored in the printhead. For example, the printhead may be controlled so that ink is ejected in two or more passes across the print medium, resulting in appropriate dot coverage to counter the effects of ink settling. In a specific example, the first pass results in the dot coverage shown in FIG. 8A, with subsequent passes with firing of nozzles as necessary to provide the initial coverage with additional dot coverage.

While this invention has been described in conjunction with the embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

The invention claimed is:

1. An inkjet printing device, comprising:

an inkjet printhead comprising a plurality of inkjet nozzles;

an ink concentration calculation device that determines a pigment concentration of ink ejected by the inkjet printhead relative to an initial pigment concentration of the ink; and a control module operatively connected to receive information from the ink concentration calculation device and that determines based on the information a firing pattern for the inkjet printhead.

2. The inkjet printing device of claim 1, wherein the plurality of inkjet nozzles comprises a first column of nozzles and a second column of nozzles, and the control module determines the firing pattern by selecting from the following firing patterns:

1) a first firing pattern in which alternate nozzles from each of the first and second columns are fired with each advance of the printhead;
2) a second firing pattern in which alternate nozzles from one of the first or second columns are fired with each advance of the printhead; and
3) a third firing pattern in which identical nozzles in the first and second columns are fired with each advance of the printhead.

3. The inkjet printing device of claim 2, wherein, upon a condition that the relative pigment concentration is 1.0, the control module selects the first firing pattern which results in a dot coverage over a first percentage of a print medium area.

4. The inkjet printing device of claim 3, wherein the first percentage is 50%.

5. The inkjet printing device of claim 3, wherein, upon a condition that the relative pigment concentration is greater than a predetermined amount over 1.0, the control module selects the second firing pattern which results in a dot coverage over a second percentage of the print medium area, the second percentage being less than the first percentage.

6. The inkjet printing device of claim 5, wherein the second percentage is 45% or less.

7. The inkjet printing device of claim 3, wherein, upon a condition that the relative pigment concentration is less than a predetermined amount below 1.0, the control module selects the third firing pattern which results in a dot coverage over a third percentage of the print medium area, the third percentage being greater than the first percentage.

8. The inkjet printing device of claim 7, wherein the third percentage is 55% or greater.

9. The inkjet printing device of claim 1, further comprising a fire count detection device that detects a number of times the inkjet printhead has been activated to eject ink from one or more of the plurality of inkjet nozzles.

10. The inkjet printing device of claim 9, further comprising an ink height calculation device that determines a height of ink remaining in the ink reservoir based on the fire count detected by the fire count detection device.

11. The inkjet printing device of claim 10, wherein the calculated pigment concentration is based on the determined height and a determined period of time between a last inkjet printhead activation time and a current inkjet printhead activation time.

12. The inkjet printing device of claim 1, wherein the calculated pigment concentration of ink is determined using the Mason-Weaver Equation.

13. A method for controlling an inkjet printing device comprising an inkjet printhead having a plurality of inkjet nozzles, the method comprising the steps:

calculating a pigment concentration of ink ejected by the inkjet printhead relative to an initial pigment concentration of the ink; and determining based on the calculated pigment concentration of ink a firing pattern for the inkjet printhead.

14. The method of claim 13, wherein the plurality of inkjet nozzles comprises a first column of nozzles and a second column of nozzles, and the step of determining a firing pattern comprising selecting from the following firing patterns:

1) a first firing pattern in which alternate nozzles from each of the first and second columns are fired with each advance of the printhead;
2) a second firing pattern in which alternate nozzles from one of the first or second columns are fired with each advance of the printhead; and
3) a third firing pattern in which identical nozzles in the first and second columns are fired with each advance of the printhead.

15. The method of claim 14, wherein, upon a condition that the relative pigment concentration is 1.0, the first firing pattern is selected, which results in a dot coverage over a first percentage of a print medium area.

16. The method of claim 15, wherein the first percentage is 50%.

17. The method of claim 15, wherein, upon a condition that the relative pigment concentration is greater than a predetermined amount over 1.0, the second firing pattern is selected, which results in a dot coverage over a second percentage of the print medium area, the second percentage being less than the first percentage.

18. The method of claim 17, wherein the second percentage is 45% or less.

19. The method of claim 15, wherein, upon a condition that the relative pigment concentration is less than a predetermined amount below 1.0, the third firing pattern is selected, which results in a dot coverage over a third percentage of the print medium area, the third percentage being greater than the first percentage.

20. The method of claim 19, wherein the third percentage is 55% or greater.

* * * * *